US007856191B2

(12) United States Patent
Meetze, Jr.

(10) Patent No.: US 7,856,191 B2
(45) Date of Patent: Dec. 21, 2010

(54) POWER REGULATOR OF MULTIPLE INTEGRATED MARKING ENGINES

(75) Inventor: Murray O. Meetze, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1202 days.

(21) Appl. No.: 11/483,747

(22) Filed: Jul. 6, 2006

(65) Prior Publication Data

US 2008/0008492 A1 Jan. 10, 2008

(51) Int. Cl.
*G03G 15/00* (2006.01)

(52) U.S. Cl. ..... 399/70; 300/37; 300/88

(58) Field of Classification Search ..... 399/37, 399/70, 88

See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,008,713 | A | 4/1991 | Ozawa et al. |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,629,762 | A | 5/1997 | Mahoney et al. |
| 5,710,968 | A | 1/1998 | Clark et al. |
| 5,778,377 | A | 7/1998 | Marlin et al. |
| 5,859,711 | A * | 1/1999 | Barry et al. ..... 358/296 |
| 5,884,910 | A | 3/1999 | Mandel |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—David M Gray
*Assistant Examiner*—G. M. Hyder
(74) *Attorney, Agent, or Firm*—Fay Sharpe LLP

(57) ABSTRACT

A printing device is provided comprising multiple marking engines including at least one marking engine and at least another marking engine that during operation place marks on output media. A power supply is further provided that selectively supplies selected levels of power from the at least one marking engine to the at least another marking engine for selected times so as to rotate readiness from the at least one marking engine to the at least another marking engine for operation to and from a dormant state. Power from the power supply is selectively distributed to the multiple marking engines so that the at least one marking engine is readied for operation while the at least another marking engine is removed from readiness.

13 Claims, 6 Drawing Sheets

U.S. PATENT DOCUMENTS

| | | | | |
|---|---|---|---|---|
| 5,915,148 | A * | 6/1999 | Hamaguchi et al. | 399/77 |
| 5,995,721 | A | 11/1999 | Rourke et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,341,773 | B1 | 1/2002 | Aprato et al. | |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,636,326 | B1 * | 10/2003 | Zuber | 358/1.14 |
| 6,639,669 | B2 | 10/2003 | Hubble, III et al. | |
| 6,819,906 | B1 | 11/2004 | Herrmann et al. | |
| 6,925,283 | B1 | 8/2005 | Mandel et al. | |
| 6,959,165 | B2 | 10/2005 | Mandel et al. | |
| 6,973,286 | B2 | 12/2005 | Mandel et al. | |
| 7,024,152 | B2 | 4/2006 | Lofthus et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |
| 2006/0033771 | A1 | 2/2006 | Lofthus et al. | |
| 2006/0039728 | A1 | 2/2006 | deJong et al. | |
| 2006/0066885 | A1 | 3/2006 | Anderson et al. | |
| 2006/0067756 | A1 | 3/2006 | Anderson et al. | |
| 2006/0067757 | A1 | 3/2006 | Anderson et al. | |

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Dec. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/349,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.
U.S. Appl. No. 11/417,411, filed May 4, 2006, Degruchy.
U.S. Appl. No. 11/432,924, filed May 12, 2006, Lieberman et al.
U.S. Appl. No. 11/432,905, filed May 12, 2006, Mongeon et al.
U.S. Appl. No. 11/432,993, filed May 12, 2006, Anderson.

* cited by examiner

| JOB (A) = 180 PAGES: | RT(n) | WUT(n+1) SCHEDULE | |
|---|---|---|---|
| n=1 | 195 seconds | > 35 seconds | A1 |
| n=2 | 115 seconds | > 65 seconds | A2 |
| n=3 | 98 seconds | < 125 seconds | A3 |
| n=4 | 98 seconds | | |

| JOB (B) = 360 PAGES: | RT(n) | WUT(n+1) SCHEDULE | |
|---|---|---|---|
| n=1 | 375 seconds | > 35 seconds | B1 |
| n=2 | 205 seconds | > 65 seconds | B2 |
| n=3 | 158 seconds | > 125 seconds | B3 |
| n=4 | 150 seconds | | B4 |

Question: RTn > WUT n+1 if yes, bring up (n+1) IMES

POWER REGULATOR OF MULTIPLE INTEGRATED MARKING ENGINES

BACKGROUND

The present disclosure relates to regulating a printing device or machine having multiple Integrated Marking Engines (IMEs). It finds particular application in conjunction with xerographic devices or machines, and will be described with particular reference thereto. However, one of ordinary skill in the art will appreciate that it is also amenable to other like applications.

Printing devices are known to include multiple IMEs. For example, printing devices are known which include two or more IMEs. Typically, before such printing devices begin printing, each IME therein is warmed-up. The IME warm-up commonly occurs during the initial powering-up or turning-on of the printing device, or when the printing device is awoken from a sleep, power saver or other like power conservation mode. IME warm-up generally includes supplying electrical power to the IME for a period of time, e.g., to bring a fuser and/or other components of the IME from a lower ambient temperature up to a target operating temperature or otherwise prepare the IME for operation. Once the warm-up is completed, the power supplied to the IME can be typically reduced from a warm-up level to a lower operating level.

Generally speaking, there are typically several levels of power consumption in a machine that depend on the mode or state of operation of the machine at the moment. These modes include (1) off wherein no power is being consumed, (2) power saver is a dormant state wherein very low power is being consumed for vital functions such as monitoring for incoming print or fax jobs, (3) warm-up wherein a relatively large amount of power is being consumed to bring the machine from off or power saver to the ready states, (4) standby wherein the machine is ready but not running a job and (5) run wherein the machine is ready and running a job. In order to conserve energy, the machine is typically programmed to go from run to standby whenever there are no more jobs in the queue to be printed and then to go from standby to power saver after a period of inactivity.

Conventionally, all the components (including the IMEs) within an integrated printing device are warmed-up simultaneously even though the power required for warm-up may be greater than the power required to run the device after warm-up. Accordingly, the total power available to the device for warm-up is divided among all of the components in the device. When the device contains multiple integrated IMEs, the power service to the device, or the limitations of the power supplies within the device, may limit the power available for warm-up when the IMEs all warm-up simultaneously. Depending on various factors, e.g., the thermal mass of the individual fusers and the total available power for IME warm-up, the warm-up time for the printing device can be undesirably long. Moreover, the simultaneous warm-up of multiple IMEs within a printing device can negatively impact a first-page-out-time (FPOT) of the printing device, i.e., the time it takes for the printing device in a given instance to provide or output the first copied or printed page of an input job. Generally, a long FPOT can result in dissatisfaction to the user.

A recent improvement for limiting or reducing the FPOT in a multiple IME device has been described as sequential warm-up of IMEs. Sequential warm-up provides for the maintenance of power consumption within acceptable limits, yet minimizes the impact on warm-up time. However, all the IMEs within the printing device may be typically warmed-up in the same sequential order (i.e. IME-1 warmed-up first, IME-2 warmed-up second, IME-3 warmed-up third, etc.). The same pattern of usage and/or powering up of the individual IMEs can result in uneven utilization of certain IMEs and uneven use of consumables consumption or customer replaceable units (CRU) as the IMEs typically begin printing as soon as they are warmed up. Alternatively, the sequential warming-up or powering-up IMEs may be done simultaneously or at random without regard to the duration of processing the immediate jobs relative to the duration required to power-up one or more additional IMEs. In either case, the FPOT may be longer than necessary and the use of power may be greater than necessary for situations where the jobs are short run and are spaced out over time.

Accordingly, a new and improved multiple IME printing device and/or method for warming-up multiple IMEs within a printing device are disclosed that overcome the above-referenced problems and others.

CROSS REFERENCE TO RELATED PATENTS AND APPLICATIONS

The following applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

U.S. Publication No. US-2006-0067756-A1, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Publication No. US-2006-0067757-A1, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. Publication No. US-2006-0033771-A1, published Feb. 16, 2006, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Publication No. US-2006-0039728-A1, published Feb. 23, 2006, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled "IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. Publication No. US-2006-0066885-A1, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM," by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS," by Goodman, et al.;

U.S. application Ser. No. 11/234,553, filed Sep. 23, 2005, entitled "MAXIMUM GAMUT STRATEGY FOR THE PRINTING SYSTEMS," by Michael C. Mongeon;

U.S. application Ser. No. 11/234,468, filed Sep. 23, 2005, entitled "PRINTING SYSTEM," by Eric Hamby, et al.;

U.S. application Ser. No. 11/247,778, filed Oct. 11, 2005, entitled "PRINTING SYSTEM WITH BALANCED CONSUMABLE USAGE," by Charles Radulski, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/274,638, filed Nov. 15, 2005, entitled "GAMUT SELECTION IN MULTI-ENGINE SYSTEMS," by Wencheng Wu, et al.;

U.S. application Ser. No. 11/287,177, filed Nov. 23, 2005, entitled "MEDIA PASS THROUGH MODE FOR MULTI-ENGINE SYSTEM," by Barry P. Mandel, et al.;

U.S. application Ser. No. 11/287,685, filed Nov. 28, 2005, entitled "MULTIPLE IOT PHOTORECEPTOR BELT SEAM SYNCHRONIZATION," by Kevin M. Carolan;

U.S. application Ser. No. 11/291,860 , filed Nov. 30, 2005, entitled "MEDIA PATH CROSSOVER CLEARANCE FOR PRINTING SYSTEM," by Keith L. Willis;

U.S. application Ser. No. 11/292,388 , filed Nov. 30, 2005, entitled "PRINTING SYSTEM," by David A. Mueller;

U.S. application Ser. No. 11/292,163 , filed Nov. 30, 2005, entitled "RADIAL MERGE MODULE FOR PRINTING SYSTEM," by Barry P. Mandel, et al.;

U.S. application Ser. No. 11/291,583 , filed Nov. 30, 2005, entitled "MIXED OUTPUT PRINTING SYSTEM," by Joseph H. Lang;

U.S. application Ser. No. 11/312,081 , filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/314,828 , filed Dec. 21, 2005, entitled "MEDIA PATH DIAGNOSTICS WITH HYPER MODULE ELEMENTS," by David G. Anderson, et al;

U.S. application Ser. No. 11/314,774 , filed Dec. 21, 2005, entitled "METHOD AND APPARATUS FOR MULTIPLE PRINTER CALIBRATION USING COMPROMISE AIM," by R. Victor Klassen;

U.S. application Ser. No. 11/317,589 , filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/317,167 , filed Dec. 23, 2005, entitled "PRINTING SYSTEM," by Robert M. Lofthus, et al.;

U.S. application Ser. No. 11/331,627 , filed Jan. 13, 2006, entitled "PRINTING SYSTEM INVERTER APPARATUS", by Steven R. Moore;

U.S. application Ser. No. 11/341,733 , filed Jan. 27, 2006, entitled "PRINTING SYSTEM AND BOTTLENECK OBVIATION", by Kristine A. German;

U.S. application Ser. No. 11/349,828 , filed Feb. 8, 2005, entitled "MULTI-DEVELOPMENT SYSTEM PRINT ENGINE", by Martin E. Banton;

U.S. application Ser. No. 11/359,065, filed Feb. 22, 2005, entitled "MULTI-MARKING ENGINE PRINTING PLATFORM", by Martin E. Banton;

U.S. application Ser. No. 11/363,378, filed Feb. 27, 2006, entitled "SYSTEM FOR MASKING PRINT DEFECTS", by Anderson, et al.;

U.S. application Ser. No. 11/364,685, filed Feb. 28, 2006, entitled "SYSTEM AND METHOD FOR MANUFACTURING SYSTEM DESIGN AND SHOP SCHEDULING USING NETWORK FLOW MODELING", by Hindi, et al.;

U.S. application Ser. No. 11/378,046, filed Mar. 17, 2006, entitled "PAGE SCHEDULING FOR PRINTING ARCHITECTURES", by Charles D. Rizzolo, et al.;

U.S. application Ser. No. 11/378,040, filed Mar. 17, 2006, entitled "FAULT ISOLATION OF VISIBLE DEFECTS WITH MANUAL MODULE SHUTDOWN OPTIONS", by Kristine A. German, et al.;

U.S. application Ser. No. 11/399,100, filed Apr. 6, 2006, entitled "SYSTEMS AND METHODS TO MEASURE BANDING PRINT DEFECTS", by Peter Paul;

U.S. application Ser. No. 11/403,785, filed Apr. 13, 2006, entitled "MARKING ENGINE SELECTION", by Martin E. Banton et al.;

U.S. application Ser. No. 11/417,411, filed May 4, 2006, entitled "DIVERTER ASSEMBLY, PRINTING SYSTEM AND METHOD", by Paul J. Degruchy;

U.S. application Ser. No. 11/432,993, filed May 12, 2006, entitled "TONER SUPPLY ARRANGEMENT", by David G. Anderson;

U.S. application Ser. No. 11/432,924, filed May 12, 2006, entitled "AUTOMATIC IMAGE QUALITY CONTROL OF MARKING PROCESSES", by David J. Lieberman;

U.S. application Ser. No. 11/432,905, filed May 12, 2006, entitled "PROCESS CONTROLS METHODS AND APPARATUSES FOR IMPROVED IMAGE CONSISTENCY", by Michael C. Mongeon et al.;

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled "IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled "PRINTING SYSTEMS", by Kristine A. German et al.;

U.S. application Ser. No. 11/137,634, filed May 25, 2005, entitled "PRINTING SYSTEM", by Robert M. Lofthus et al.;

U.S. application Ser. No. 11/137,251, filed May 25, 2005, entitled "SCHEDULING SYSTEM", by Robert M. Lofthus et al.;

U.S. C-I-P application Ser. No. 11/137,273, filed May 25, 2005, entitled. "PRINTING SYSTEM", by David G. Anderson et al.;

U.S. application Ser. No. 11/143,818, filed Jun. 2, 2005, entitled "INTER-SEPARATION DECORRELATOR", by Edul N. Dalal et al.; and, U.S. application Ser. No. 11/146,665, filed Jun. 7, 2005, entitled "LOW COST ADJUSTMENT METHOD FOR PRINTING SYSTEMS", by Michael C. Mongeon.

BRIEF DESCRIPTION

Aspects of the present disclosure, in embodiments thereof, include a printing device comprising multiple marking engines including at least one marking engine and at least another marking engine that during operation place marks on output media such as paper. A power supply is provided that selectively supplies selected levels of extra power at first to the at least one marking engine and subsequently to the at least another marking engine for selected times so as to rotate readiness from the at least one marking engine to the at least another marking engine for operation to and from a dormant state. Power from the power supply is selectively distributed to the multiple marking engines so that the at least one marking engine is readied for operation while the at least another marking engine is removed from readiness.

Aspects of the present disclosure, in embodiments thereof, include a xerographic imaging device comprising a first integrated marking engine selectively putting marks on output media during its operation. The device further comprising a second integrated marking engine selectively putting marks on output media during its operation. A power supply is provided that selectively supplies selected levels of electrical power to the first and second integrated marking engines so as to get them ready for operation from a dormant state and to power their operation. A scheduler is further provided that quantifies a run time for a job and compares to a time to make ready the first integrated marking engine and at least a second integrated marking engine, wherein an amount of power from the power supply is distributed to the first integrated marking engine and selectively distributed to the at least second integrated marking engine based on whether the run time using the first integrated marking engine exceeds the time to make ready the first and second integrated marking engines.

Aspects of the present disclosure, in embodiments thereof, comprise a printing device including a first marking engine selectively marking output media during its operation and having a warm-up period associated therewith in which the first marking engine is prepared for operation. The device further including a second marking engine selectively marking output media during its operation and having a warm-up period associated therewith in which the second marking engine is prepared for operation. A power supply is provided that selectively supplies electrical power to the first and second marking engines. The power supply provides warm-up power to the first and second marking engines during their respective warm-up periods to prepare them for operation, and provides operating power to the first and second marking engines to power their operation. The selective supplying of power to the second marking engine occurs when the job length run time of the first marking engine exceeds the warm-up time for the first and second marking engines.

Numerous benefits of the subject matter disclosed herein will become apparent to those of ordinary skill in the art upon reading and understanding the present specification.

BRIEF DESCRIPTION OF THE DRAWINGS

The subject matter of the present disclosure may take form in various components and arrangements of components, and in various steps and arrangements of steps. The drawings are only for purposes of illustrating preferred embodiments and are not to be construed as limiting. Further, it is to be appreciated that the drawings are not to scale.

DETAILED DESCRIPTION

To be described in more detail hereinafter, energy saving and environmental considerations result in partial shut down of integrated marking engines during periods of non-use. A timer can be started each time the print queue is depleted due to completion of all printing jobs. After a predetermined period of inactivity, the system can go into a power conservation, or power saver, mode where the power used by the system is reduced. Some of the biggest consumers of energy in the multifunctional integrated marking engines are fusers and scanner lamps which may also have the longest warm-up time (WUT). When integrated marking engines are integrated together in a printing system, a user sometimes must choose a compromise between the cost of energy consumed and the value of productivity when a system of individual integrated marking engines includes using each marking engine selectively and intermittently.

Figure 1:
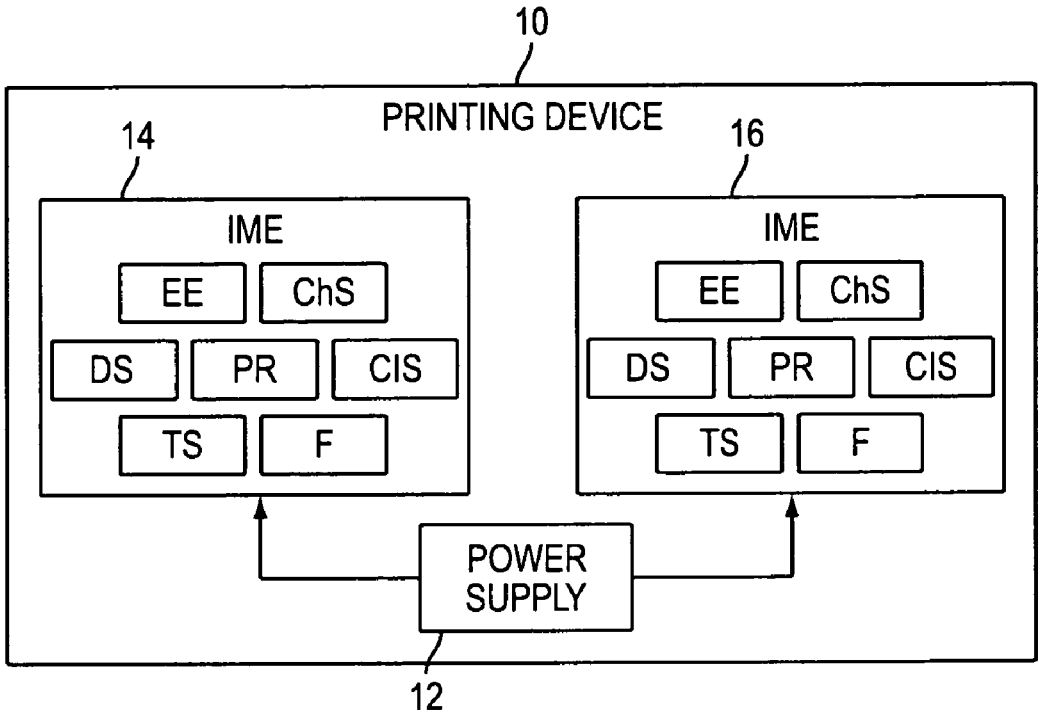
FIG. 1 is diagrammatic illustration showing an example embodiment of a multiple IME printing device.

With reference to FIG. 1, an imaging and/or printing device 10 includes multiple IMEs and a power supply 12. As illustrated, the printing device 10 includes two IMEs, namely, a first IME 14 and a second IME 16. While only two IMEs are shown for simplicity and clarity herein, optionally, the printing device 10 may include more than two IMEs. Suitably, the printing device 10 can be a copier, printer, a facsimile machine, a multi-function device or other like imaging and/or printing device, and the IMEs can be implemented as xerographic or other like electrostatic imaging and/or printing modules that image, print or otherwise place marks on an output medium, such as a sheet of paper. Each IME is suitably equipped in the usual manner, e.g., with a photoreceptor (PR), a fuser (F), a charging station (ChS), exposing equipment (EE), a developing station (DS), a transferring station (TS), and a cleaning station (CIS). Alternately, the multiple IMEs may be implemented in any customary manner. For example, in one alternate embodiment, the printing device 10 is a solid ink printing device in which the IMEs 14 and 16 are optionally implemented as print-heads and/or solid ink printing modules which use melted solid ink to selectively place marks on an output media.

In the illustrated embodiment, the power supply 12 selectively supplies electrical power to both the first and second IMEs 14 and 16. Prior to operation of the individual IMEs, each IME is warmed-up, e.g., by the power supply 12 supplying a selected level of power thereto (referred to as the warm-up power level) for a selected period of time (referred to as the warm-up time [WUT]). Warming-up the IME raises its fuser and/or other selected components from a lower, i.e. ambient, temperature up to a target operating temperature or otherwise prepares the IME for operation from a dormant or non-operational power saver state. For example, in a solid ink embodiment, warming-up the IMEs relates to raising the temperature of their print-heads and/or other heating elements so as to be suitable for melting and/or otherwise flowing the solid ink used thereby. Suitably, IME warm-up occurs during the initial powering-up or turning-on of the printing device 10, or when the printing device 10 is awoken from a sleep, stand-by, power saver, or other like power conservation mode. Once a particular IME has been warmed-up, the power supply 12 selectively drops the power level supplied thereto down from the warm-up power level to a selected lower level (referred to as the operating power level).

The system can invoke the power saving mode of operation for periods when the full capabilities of the system are not needed. The system can include a regulator for partitioning power to the system and to the functional integrated marking engines wherein individual marking engines can be independently brought into and out of the power saving mode for intermittent jobs. The system can control the power mode of each of the individual marking engines such that one or more of the marking engines is available in fully powered mode for fast response while one or more of the other marking engines are conserving power in the power saver mode. To be described in more detail below, moving one or more of the integrated marking engines from power saver mode to fully ready mode can be dependent upon the run length or run time (RT) of the pending job(s). The pending jobs can include an initial job(s) plus subsequently added job(s).

According to one embodiment, the system can continuously monitor, quantify, and update the run time (RT) of pending print jobs in the print queue and the warm-up time of each engine in power saver mode. Whenever there are jobs in the print queue, at least one IME either in the ready state or brought out of power saver by warming up. Considering the additional engines that are in the power saver mode, when the RT exceeds the WUT of any engine in power-saver mode by a margin (M1), then that engine is brought online to begin printing as soon as possible. When the RT exceeds the WUT of any two engines in power saver mode by a longer margin, (M2), then a second marking engine is also brought online as soon as possible. When the RT exceeds the WUT of any three engines in power saver mode of still a longer margin, (M3), then a third marking engine is brought online or out of power saver mode, etc. The system can return marking engines to power saver mode as print jobs are completed or after a period of inactivity. In one arrangement, all marking engines except one are returned to power saver mode immediately when no print jobs are pending.

The margins, M1, M2, M3, can be set according to the needs of the user for balancing productivity with power consumption. If for instance, the fuser warm-up time after an extended period in power saver mode is one minute and the run length or time of intermittent jobs is typically more than 5 minutes and the jobs come in bunches, then M1, M2, M3 might all be set for 1 minute. It is to be appreciated that all marking engines would be readied as soon as possible. On the other hand, if the run length varies with the time of day and is typically less than a minute during the day, but longer than 3 minutes at other times and longer than 5 minutes at still other times, then the margins can be set at 1, 3, and 5 minutes, respectively.

According to another embodiment, all the IMEs in the printing device 10 are not warmed-up simultaneously or otherwise brought concurrently to their operational states. Rather, power is selectively distributed from the power supply 12 to the various IMEs in the printing device 10 so as to ready at least one IME for operation prior to at least one other IME. Suitably, the FPOT of the printing device 10 is in this manner reduced from what it would otherwise be if all the IMEs in the printing device 10 were warmed-up simultaneously or otherwise brought concurrently to their operational states.

FIGS. 2 and 3 provide alternative examples of power distribution schemes for use in a multiple IME printing device, such as the one illustrated in FIG. 1. For purposes of these examples, the IMEs 14 and 16 are considered substantially similar with respect to power consumption and output speed; however, this does not have to be the case. That is to say, optionally, the different IMEs included in the printing device 10 optionally have different power consumptions and/or output speeds.

FIGS. 2A-2D show a heretofore typical power distribution scheme that simultaneously warms-up or otherwise brings both the IMEs 14 and 16 concurrently to their operational states from dormant states.

FIGS. 3A-3D show sequential warm-up including bringing one IME to its operationally ready state from a dormant state prior to the second IME 16 achieving operational readiness. Suitably, each IME has or is characterized by: an output speed (OS) which can be measured, e.g., in pages per minute (ppm);

an operational power level (OPL); a nominal warm-up power level (NWUPL); and a nominal warm-up time (NWUT), which is the warm-up time for the IME when powered at the nominal warm-up power level. For purposes of this example, the OS of each IME is assumed to be about 65 ppm, the OPL is assumed to be about 1000 watts (W), the NWUPL is assumed to be about 2000 W; and the NWUT is assumed to be about 30 seconds (s). The NWUT can vary in time based upon total power available, the total number of IMEs, and/or extent of cool down (proximity to ambient temperature) for each individual IME. Furthermore, it shall be assumed that the total power that can be-output or supplied by the power supply 12 at any given point in time is set at about 4000 W.

Figure 2A:
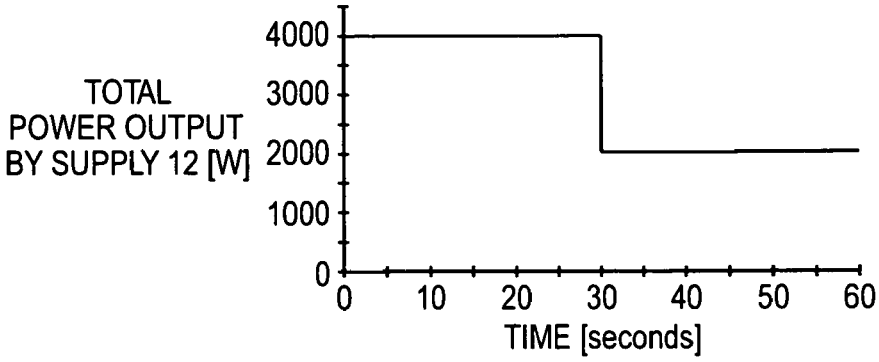
FIGS. 2A-2D represent a diagram showing a typical power distribution scheme along with corresponding output capacity for a multiple IME printing device.
Figure 2B:
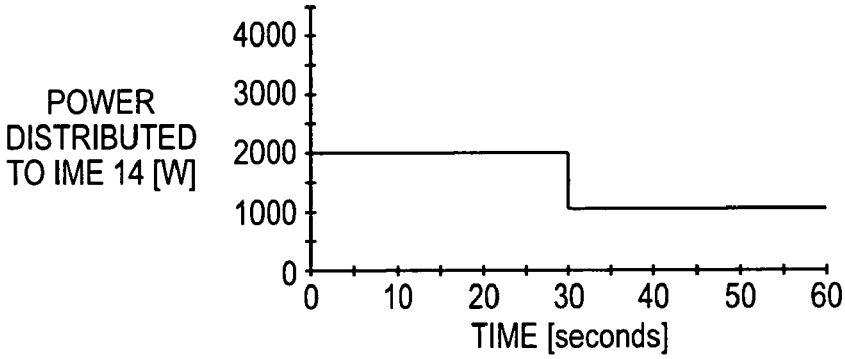
Figure 2C:
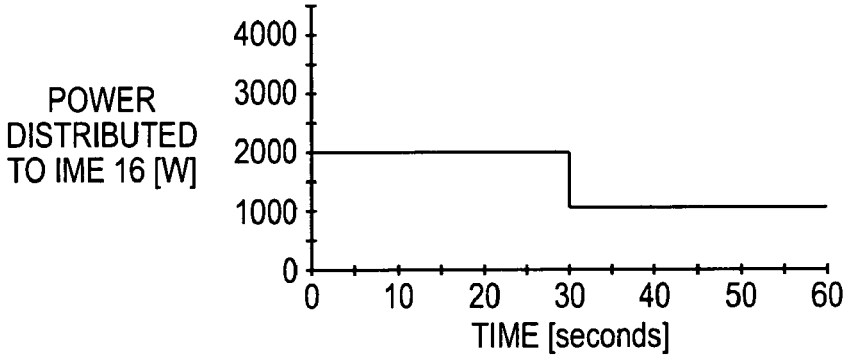
Figure 2D:
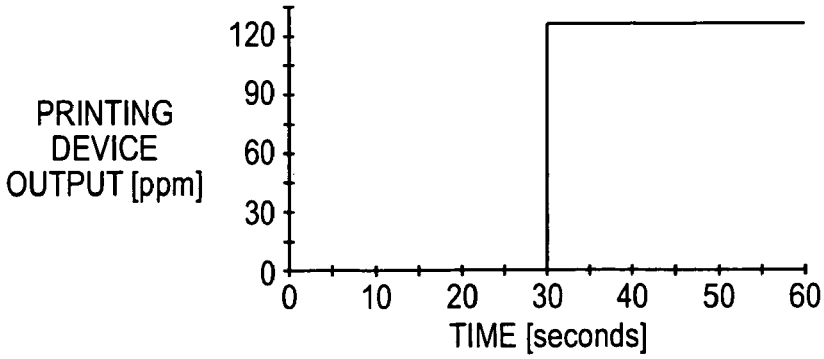

With reference again to FIGS. 2A-2D, both IMEs 14 and 16 begin warming-up at time T=0. As shown, the IMEs 14, 16 are simultaneously warmed-up. The total power output (FIG. 2A) from the power supply 12 (i.e., about 4000 W) is distributed substantially equally to each IME. That is to say, the IME 14 receives about 2000 W (FIG. 2B) and the IME 16 receives about 2000 W (FIG. 2C). The warm-up power level is about the same for both the IMEs 14 and 16, therefore, both the IMEs 14 and 16 are brought to operational readiness at about the same time. More specifically, as they are each receiving the NWUPL, both the IMEs 14 and 16 achieve operational readiness about 30 s later or at T=30 sec. given the NWUT. At T=30 sec. (i.e., after both the IMEs 14 and 16 have completed warming-up), the power supplied by the power supply 12 to each IME is dropped to the OPL (i.e., about 1000 W). The printing device 10, at this point, has achieved its full operational productivity and/or capacity (i.e., about 130 ppm) insomuch as both IMEs are now warmed-up or otherwise operationally ready (FIG. 2D). However, the printing device 10 is not capable of outputting copied, printed or otherwise marked pages prior to this time insomuch as no IME is operationally ready at any earlier point in time.

Figure 3A:
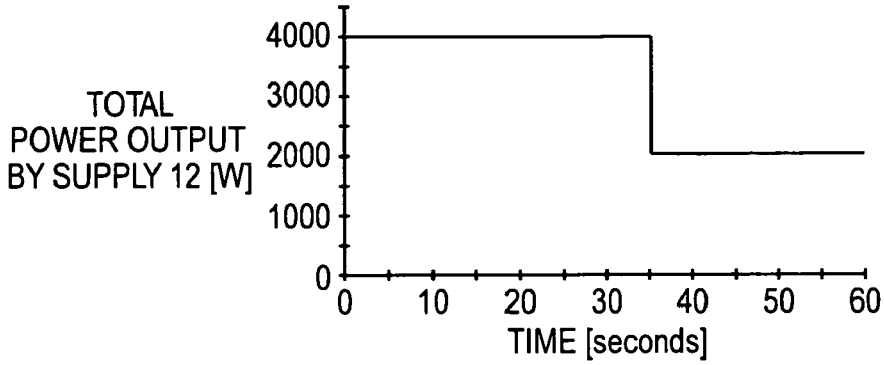
FIGS. 3A-3D represent a diagram showing an example power distribution and power saver scheme along with corresponding output capacity for a multiple IME printing device in accordance with the present disclosure.
Figure 3B:
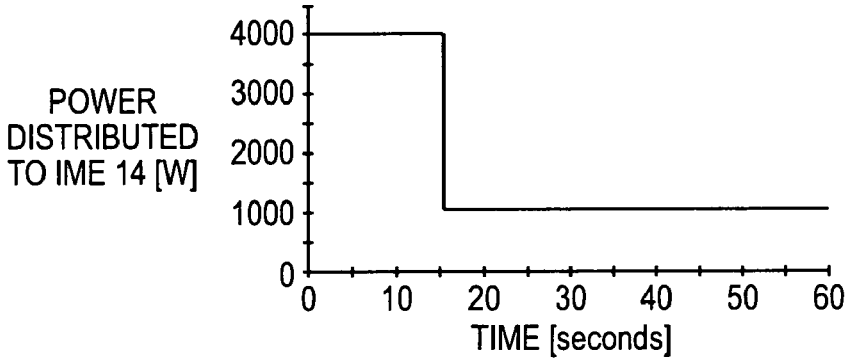

With reference now to FIGS. 3A-3D, only IME 14 begins warming-up at time T=0. The total power output from the power supply 12 (i.e., about 4000 W) is distributed entirely to the IME 14 (FIG. 3B). That is to say, the IME 14 receives about 4000 W and the IME 16 receives about 0 W. As the IME 14 is receiving greater than the NWUPL, the warm-up time for the IME 14 is reduced relative to the NWUT. More specifically, as the IME 14 is receiving about twice the NWUPL, the IME 14 achieves operational readiness in about 15 s (i.e., in about half the NWUT), or at T=15 s. The printing device 10 is now capable of outputting copied, printed or otherwise marked pages insomuch as at least one IME is operationally ready. Accordingly, one of ordinary skill in the art will appreciate that the FPOT of the printing device 10 is reduced as compared to the example of FIGS. 2A-2D, by as much as half or 15 s in this particular instance. However, the printing device 10, at this point, has only achieved about half its operational productivity and/or capacity (i.e., 65 ppm) insomuch as only one of the two IMEs is now warmed-up or otherwise operationally ready.

Figure 3C:
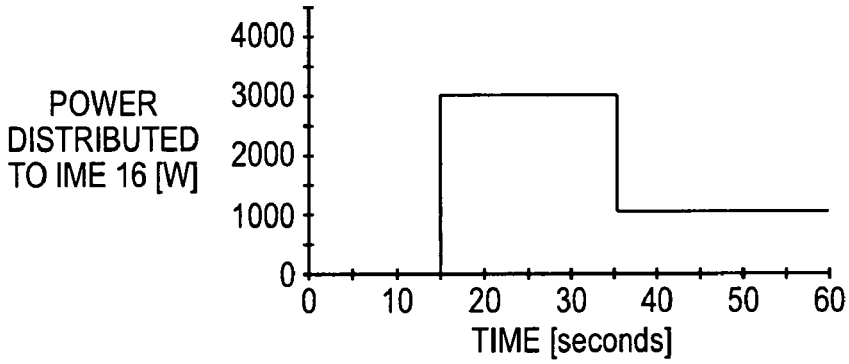
Figure 3D:
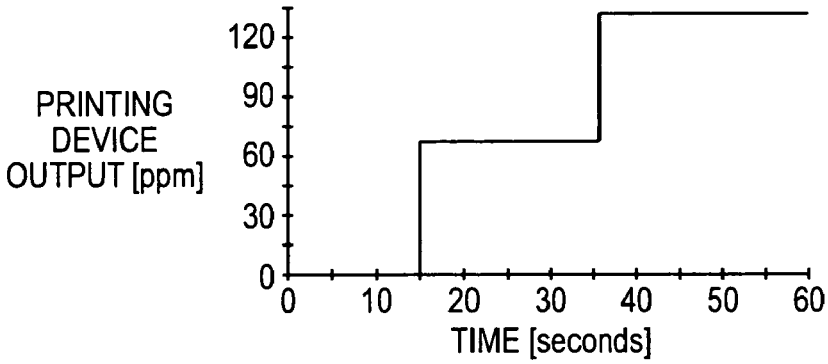
Figure 4A:
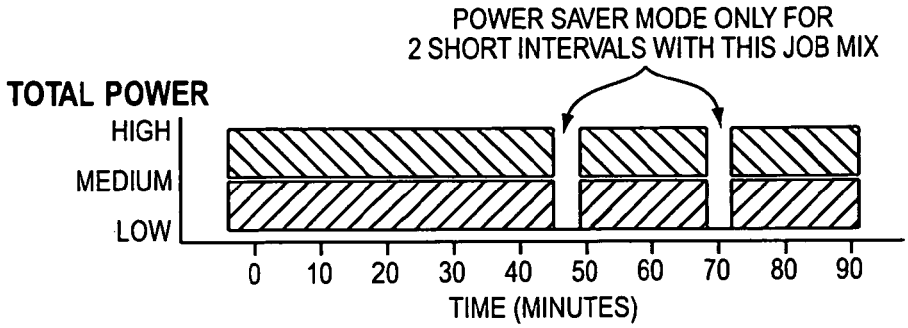
FIGS. 4A-4D represent a graphical representation of power consumption for two IMEs programmed to shut off after a predeterminable period of inactivity.
Figure 4B:
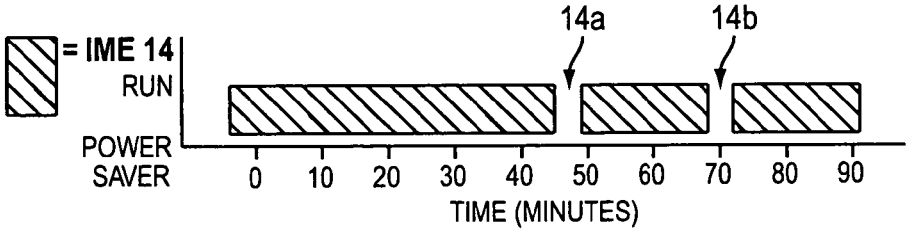
Figure 4C:
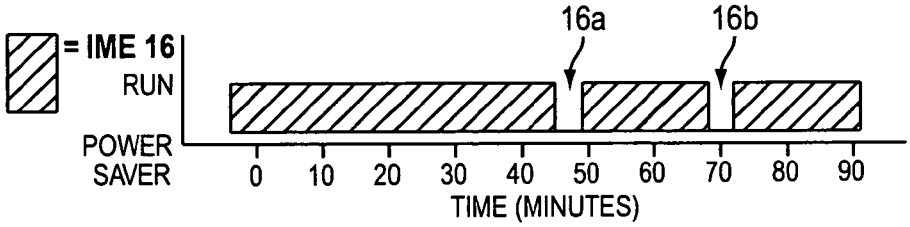
Figure 4D:
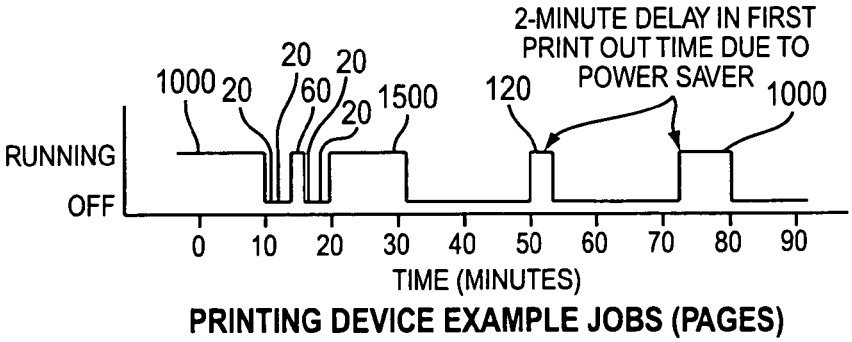

At T=15 s (i.e., after the IME 14 has completed warming-up), the power supplied by the power supply 12 to the IME 14 is dropped to the OPL (i.e., about 1000 W). This leaves a remainder of about 3000 W that the power supply 12 now applies or provides to the second IME 16 (FIG. 3C). As the IME 16 is receiving power greater than the NWUPL, the warm-up time for the IME 16 is reduced relative to the NWUT. More specifically, as the IME 16 is receiving about 3/2 of the NWUPL, the IME 16 achieves operational readiness in about 20 s (i.e., in about 2/3 of the NWUT), or at T=35 s. Now that the IME 16 has completed warming-up, the power supplied by the power supply 12 to the IME 16 is also dropped to the OPL (i.e., about 1000 W). The printing device 10, at this point, has achieved its full operational productivity and/or capacity (i.e., about 130 ppm) insomuch as both IMEs are now warmed-up or otherwise operationally ready (FIG. 3D).

One of ordinary skill in the art will appreciate that the cost for improving the FPOT via sequential or non-simultaneous IME warm-up is a slight delay ($\Delta t$) in the time it take to achieve full productivity for the printing device 10. In the forgoing example, when FIGS. 3A-3D are compared to FIGS. 2A-2D, the time to full productivity of the printing device 10 is merely extended by about 12.5%, or 5 s in this particular instance. This $\Delta t$ is maintained relatively low by having a substantial difference between the NWUPL and OPL of the IMEs 14 and 16. As the difference in these power levels increase, $\Delta t$ decreases, and vice versa. In the forgoing example, one of ordinary skill in the art will also appreciate that a total throughput of the printing device 10 (i.e., total pages output by the printing device 10 from the time T=0 s) is, for all times, greater in the example of FIGS. 3A-3D as compared to the example of FIGS. 2A-2D.

Suitably, as illustrated in FIGS. 3A-3D, each IME in the printing device 10 is warmed-up sequentially, with the next IME not beginning warm-up or otherwise receiving warm-up power from the supply 12 until the previous IME has completed warming-up. Alternately, the warm-up power is distributed to the various IMEs from the power supply 12 in staggered or overlapping time intervals. For example, the warm-up of a subsequent IME may begin prior to the preceding IME completing its warm-up. In other suitable embodiments, the IMEs in the printing device 10 may begin warming-up at the same time but at different rates. For example, the power distribution from the power supply 12 may favor one IME over another so that the former achieves operational readiness prior to the later. Alternately, the power distribution may be substantially equal to both IMEs, but the one IME may have a lower NWUPL or NWUT as compared to the other. Additionally, while FIG. 3 shows substantially constant or level power supplies being provided to the IMEs by the power supply 12 during their respective warm-ups, in alternate embodiments, the power provided to the IMEs by the power supply 12 during their respective warm-ups may vary over the warm-up time or take the shape of an arbitrary waveform, including, e.g., stepped, sloping, curving or other waveforms. In short, having read and understood the present specification, those of ordinary skill in the art will appreciate that a suitable power distribution scheme can be devised for a particular printing device having multiple IMEs to achieve a desired balance between the FPOT and the time it takes the printing device to reach its full productivity level by suitably distributing the supply of available power to the multiple IMEs within the printing device such that at least one of the IMEs is readied for operation prior to at least one of the other IMEs.

Referring now to FIGS. 4A-4D wherein graphs are displayed showing individual and total power consumption of IMEs 14, 16 that is typical of the prior art. By way of example, a system including two (2) integrated marking engines can provide power selectively to each integrated marking engine and each integrated marking engine can be independently in the fully powered or ready mode. Alternatively, each marking engine can be in a power saver mode. The total run time for processing exemplary print jobs is provided in FIG. 4D. As shown, IMEs 14, 16 are simultaneously warmed-up and simultaneously shut-down after a predeterminable period of time (i.e. 15 minutes). In this manner, all of the IMEs are 'time sensitive' and respond in like manner, for example shutting down after a prescribed period of inactivity. It is to be appreciated that since both IMEs 14, 16 only become inactive after 15 minutes, there are only two occurrences when the IMEs are inactive 14*a*, 14*b* (FIG. 4B), and 16*a*, 16*b* (FIG. 4C), respectively. These two occurrences represent the only periods when the IMEs are in power saver mode.

Figure 5A:
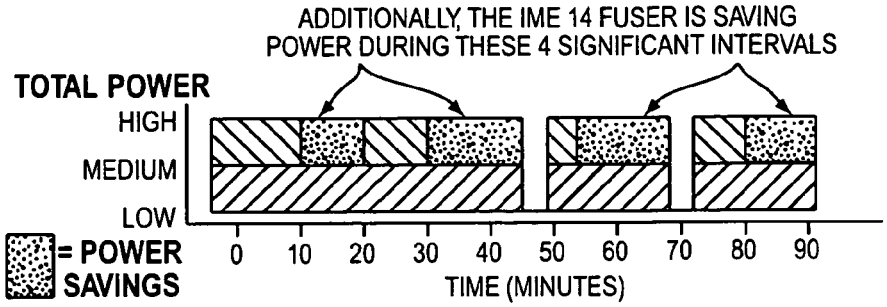
FIGS. 5A-5D represent a graphical representation of power consumption for two IMEs wherein one IME remains ready and the other IME is shut down at the end of each print job; and, FIG. 6 provides an exemplary spreadsheet showing another example of output capacity relative to time, IME readiness, and number of operating IME printing devices.
Figure 5B:
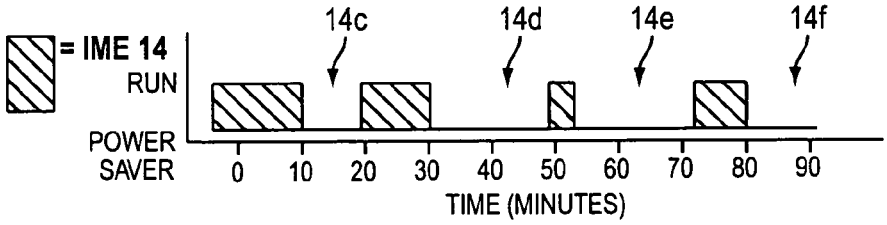
Figure 5C:
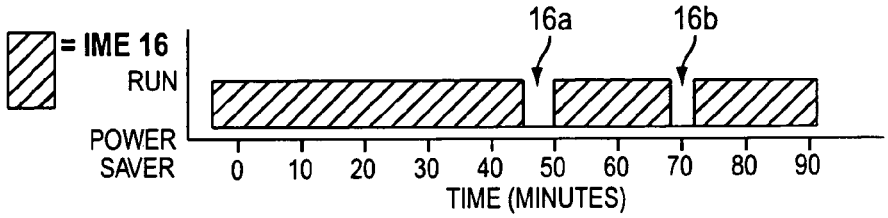
Figure 5D:
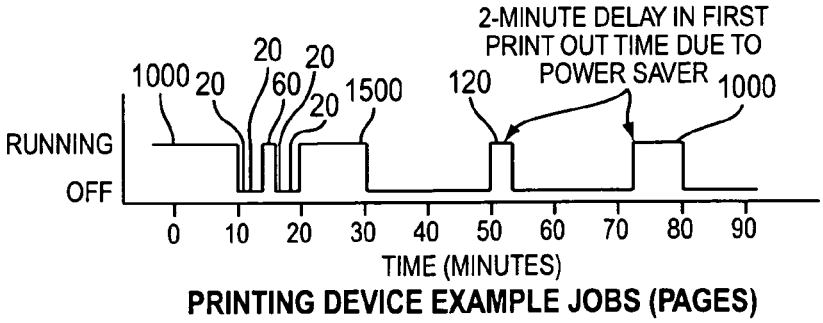

Power consumption can be altered as in the embodiment shown in FIGS. 5A-5D. In consideration of conserving power and yet optimizing productivity, the power can be removed from components of the device according to the usage demand. A timer can determine when a period of inactivity indicates the appropriate initiation of power saver mode. It will be appreciated that when a component such as a fuser is allowed to cool by removing its power in order to conserve power during periods of disuse, the cooling will occur over the course of time and not instantaneously. Therefore, when warm-up begins after a period without power, the warm-up time is dependent on the duration of the period without power. According to the present disclosure, when the print queue is depleted by completion of all printing jobs, the power is removed immediately from all but one of the IMEs, i.e. power is removed immediately from all but IME 16, and all but one of the IMEs, i.e. IME 14, can be maintained in power saver mode in order to optimize the conservation of power. IME 14 is powered up and used when the run length exceeds a predeterminable time period (i.e. 2 minutes). As illustrated, IME 14 is only used for job lengths of 1000, 1500, 120, and 1000 pages. IME 16, in ready mode, will respond to a timer and enter power saver mode after a predetermined period of inactivity. As displayed, IME 14 enters power saver mode at four periods 14*c*, 14*d*, 14*e*, 14*f* (FIG. 5B). IME 16 only moves to power saver mode at 16*a*, 16*b*, i.e. when inactivity exceeds 15 minutes (FIG. 5C).

In the example shown, marking engine 16 remains ready while marking engine 14 moves to power saver mode immediately when the job queue is depleted. Priorities for which marking engine remains ready can be rotated (i.e. load sharing) amongst all of the marking engines based on, for example, a calendar schedule, a set time lapse rotation, the relative remaining life of consumables and customer replaceable units (CRU), or after a predeterminable period of marking engine run time. In this manner, the total usage or run time on each marking engine is regulated thereby minimizing the number of customer interventions required for maintenance, balancing the consumption of consumables, etc. It is to be appreciated that the frequency of interventions for CRUs such as toner cartridges and fusers, is thereby reduced. This alternative power arrangement improves over the previous (FIGS. 4A-4D) arrangement by holding only one IME in ready mode when the print queue is empty and contrasts with prior systems where each component is maintained in the ready mode for some period of inactivity. The immediate return to power saver mode of all but one IME when the print queue is empty provides an improved savings in energy without significant compromise in productivity.

According to the present disclosure, the temperature of each fuser and the other components requiring warm-up is continuously monitored so that the varying warm-up time for each IME will be continuously determined when they are in power saver mode. The information regarding the momentary warm-up time for each IME is used along with information regarding the momentary combined length of print jobs in the queue to determine when additional IMEs should be warmed-up and returned to service.

It is to be appreciated that the warm-up of other IMEs is contingent on run length of jobs added to the queue and the projected warm-up time of the IMEs. The system, including a scheduler, can continuously monitor and quantify the run length or run time (RT) of pending print jobs in the print queue using (n) number of marking engines, their associated output capacities, and the sequential warm-up time of each engine in power saver mode. When the RT using (n) number of marking engines exceeds the WUT of (n+1) marking engines, then (n+1) marking engines are brought online to begin printing as soon as possible. Otherwise, only (n) number of marking engines are brought online and the (n+x) marking engines are left in power saver mode. The (+x) indicating all remaining integrated marking engines in power saver mode. The system can use computational models, along with the scheduler, to create algorithms that automatically control and modify the values of RT and WUT based on the number and print speed of the individual marking engines using the power supply restraints of the system.

Figure 6:
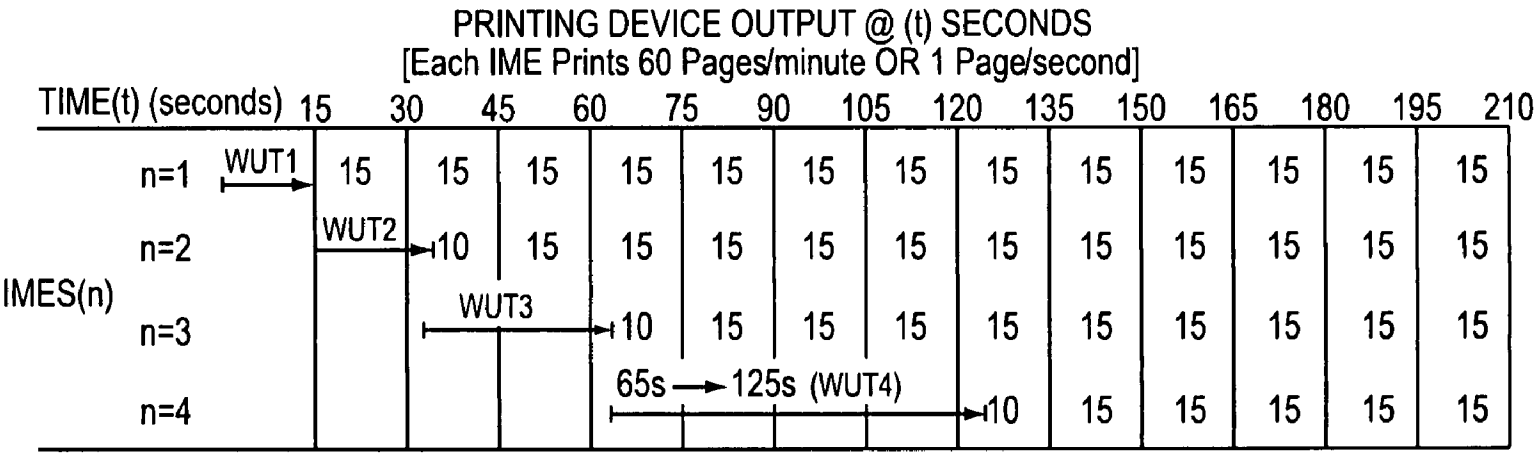

By way of example, FIG. 6 illustrates a four marking engine system and respective output capabilities using the inputs described below. Using an output speed (OS) of 60 pages/minute for each marking engine, fixed power supply of 4000 W, and sequential warm-up times consistent with the description of FIGS. 3A-3D; it is to be appreciated that the first IME would come online at 15 sec., the second IME at 35 sec., the third IME at 65 sec., and the fourth IME at 125 sec. If the print job required 180 pages to be printed, the first print engine could complete the job in 195 sec. (schedule A1); the first and second print engines could complete the job in 115 sec. (schedule A2); and the first, second, and third print engines could complete the job in 98 sec. (schedule A3). Powering up a fourth print engine would take 125 sec., but the print job would be completed at 98 sec. with three print engines using schedule A3. Thus, the fourth print engine would not be powered up and power could be conserved in leaving the fourth print engine in power saver mode while minimizing the overall RT of the print job.

If the print job required 360 pages to be printed, the first print engine could complete the job in 375 sec. (schedule B1); the first and second print engines could complete the job in 205 sec. (schedule B2); the first, second, and third print engines could complete the job in 158 sec. (schedule B3); and the first, second, third, and fourth print engines could complete the job in 150 sec. (schedule B4). Therefore, since the print duration of using only three printers, i.e. 158 sec. for schedule B3, exceeds the time to power up all four print engines, i.e. 125 sec., in this example the fourth print engine would be powered up and would contribute to completing the print job according to schedule B4.

It is to be appreciated from the algorithms described above that the first marking engine has the longest run time and the largest consumption of consumables. Therefore, load and consumable consumption balancing can be accomplished by rotating which marking engine is identified as first, second, third, etc. For example, day one could initiate marking engines as first, second, third, and fourth in that order. On day two, the second marking engine could be designated as the first marking engine, the third marking engine could be designated as the second marking engine, the fourth marking engine could be designated as the third marking engine, and the first marking engine could be designated as the fourth marking engine. A similar rotation could occur on day three and each day thereafter. The scheduled rotation could also be initiated based on run time or other criteria affecting each marking engine.

In the disclosed embodiments "at least one" refers, for example, to 1 or more than 1, and "multiple" or a "plurality" refers, for example, to 2 or more than 2.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A xerographic imaging device comprising:

a first integrated marking engine, said first integrated marking engine selectively putting marks on output media during its operation;

a second integrated marking engine, said second integrated marking engine selectively putting marks on output media during its operation;

a power supply that selectively supplies selected levels of electrical power to the first and second integrated marking engines so as to get them ready for operation from a dormant state and to power their operation;

a scheduler that quantifies a run time for a job and compares to a time to make ready the first integrated marking engine and at least a second integrated marking engine, wherein an amount of power from the available power supply is selectively distributed unequally to the first integrated marking engine and to the at least second integrated marking engine based on whether the run time using the first integrated marking engine exceeds the time to make ready the first and second integrated marking engines; and, wherein the power supply produces an amount of power that is available for selective and unequal distribution to the first and second integrated marking engines to get them ready for operation and to power their operation based upon a desired balance between a first page out time and a time duration to achieve full productivity of at least the first and second marking engines.

2. The xerographic imaging device of claim 1, wherein the first and second integrated marking engines are xerographic modules including fusers.

3. The xerographic imaging device of claim 2, wherein power supplied from the power supply to the first and second integrated marking engines to get them ready for operation from their dormant states is used by the first and second integrated marking engines to heat their fusers from an ambient temperature to an operating temperature, said operating temperature being higher than said ambient temperature.

4. The xerographic imaging device of claim 3, wherein initially substantially all of the amount of power is distributed to the first integrated marking engine to get it ready for operation, then after the first marking engine is ready for operation, a portion less than all of the amount of power is distributed to the first integrated marking engine to power its operation, and a remainder of the amount of power is distributed to the second integrated marking engine to get it ready for operation.

5. The xerographic imaging device of claim 1, wherein the device is one of a copier, a printer, a facsimile machine or a multi-function device.

6. A printing device comprising:

a first marking engine, the first marking engine selectively marking output media during its operation and having a warm-up period associated therewith in which the first marking engine is prepared for operation;

a second marking engine, the second marking engine selectively marking output media during its operation and having a warm-up period associated therewith in which the second marking engine is prepared for operation;

a power supply that selectively supplies electrical power simultaneously to the first and second marking engines, the power supply providing warm-up power to the first and second marking engines during their respective warm-up periods to prepare them for operation, and providing operating power to the first and second marking engines to power their operation, wherein the selective supplying of power to the second marking engine occurs when the job length run time of the first marking engine exceeds the warm-up time for the first and second marking engines;

wherein the warm up power supply to the first marking engine and the warm up power supply to the second marking engine is selectively distributed; and, a third marking engine, wherein the third marking engine selectively marking an output media during its operation and having a warm-up period associated therewith in which the third marking engine is prepared for operation when the job length run time of the first and second marking engines exceeds the warm-up time for the first, second, and third marking engines.

7. The printing device of claim 6, wherein the xerographic modules include fusers, and at least a portion of the warm-up power supplied to the marking engines is used to heat the fusers to an operating temperature.

8. The printing device of claim 6, wherein warm-up power is not supplied to the second marking engine until the first marking engine completes its warm-up period.

9. The printing device of claim 6, wherein the warm-up powers supplied to the first and second marking engines are higher than the respective operating powers supplied thereto.

10. The printing device of claim 6, wherein the power is distributed such that for a time the first marking engine is receiving operating power while the second marking is receiving warm-up power.

11. The printing device of claim 6, wherein the power is distributed such that for a time the first marking engine is receiving operating power while the second marking is receiving power that is less than the operating power or the warm-up power.

12. The printing device of claim 6, further comprising comparing the warm-up period for an additional marking engine to the job length run time and initiating the warm-up period for the additional marking engine when the job length run time of operating marking engines exceeds the warm-up time for the additional marking engine.

13. The printing device of claim 6, wherein the warm-up period for the second marking engine begins at about a time when the warm-up period for the first marking engine ends.

* * * * *